US007299737B2

(12) United States Patent
Hajjar et al.

(10) Patent No.: US 7,299,737 B2
(45) Date of Patent: Nov. 27, 2007

(54) METHOD AND APPARATUS FOR AN ACTION SYSTEM FOR A FIREARM

(75) Inventors: Jeffrey Hajjar, Boise, ID (US); Warren Stockton, Meridian, ID (US)

(73) Assignee: Snake River Machine, Inc. ID (US)

( * ) Notice: Subject to any disclaimer, the term of this patent is extended or adjusted under 35 U.S.C. 154(b) by 0 days.

(21) Appl. No.: 11/003,073

(22) Filed: Dec. 3, 2004

(65) Prior Publication Data

US 2005/0257682 A1 Nov. 24, 2005

Related U.S. Application Data

(60) Provisional application No. 60/526,540, filed on Dec. 3, 2003.

(51) Int. Cl.
*F41A 3/36* (2006.01)

(52) U.S. Cl. ..... 89/188; 89/180

(58) Field of Classification Search ..... 89/188, 89/187.01, 187.02, 182, 183, 172, 174, 179, 89/194–197

See application file for complete search history.

(56) References Cited

U.S. PATENT DOCUMENTS

| | | | | | |
|---|---|---|---|---|---|
| 2,336,146 | A * | 12/1943 | Williams | 89/156 |
| 2,370,189 | A * | 2/1945 | Penney | 89/152 |
| 2,921,502 | A * | 1/1960 | Amsler | 89/149 |
| 2,948,185 | A * | 8/1960 | Linder | 89/183 |
| 3,153,982 | A * | 10/1964 | Seifried | 89/194 |
| 3,407,702 | A * | 10/1968 | Cermak et al. | 89/194 |
| 3,473,434 | A * | 10/1969 | Brieger | 89/181 |
| 3,738,219 | A * | 6/1973 | Febres | 89/1.703 |
| 3,848,510 | A * | 11/1974 | Wolpert | 89/173 |
| 4,922,640 | A * | 5/1990 | Toombs | 42/16 |
| 4,938,116 | A * | 7/1990 | Royster | 89/198 |
| 5,259,137 | A * | 11/1993 | Blenk et al. | 42/16 |
| 5,682,007 | A * | 10/1997 | Dobbins | 89/187.02 |
| 5,710,389 | A * | 1/1998 | Canaday | 89/194 |
| 5,983,774 | A * | 11/1999 | Mihaita | 89/187.02 |
| 6,079,138 | A * | 6/2000 | Meaker | 42/17 |
| 6,530,306 | B1 * | 3/2003 | LaFleur | 89/188 |
| 6,588,312 | B2 * | 7/2003 | Murello et al. | 89/197 |
| 6,761,102 | B2 * | 7/2004 | Giza | 89/194 |
| 2003/0150322 | A1 * | 8/2003 | Barrett | 89/182 |
| 2003/0183068 | A1 * | 10/2003 | LaFleur | 89/188 |
| 2005/0241204 | A1 * | 11/2005 | Hajjar et al. | 42/19 |

* cited by examiner

*Primary Examiner*—Michael J. Carone
*Assistant Examiner*—Stewart T Knox
(74) *Attorney, Agent, or Firm*—Factor & Lake

(57) ABSTRACT

A method and apparatus providing an action system for a firearm. The action system includes a primary roller-lock mechanism located rearward of an ejection port. The primary roller-lock mechanism includes a bolt and a first primary roller caged within the bolt. A bolt carrier ramp is attached to a bolt carrier. A barrel extension ramp is attached to a barrel extension. The first primary roller, bolt carrier ramp, and barrel extension ramp cooperate to effectively delay movement of the bolt and bolt carrier in response to firing of the firearm.

16 Claims, 8 Drawing Sheets

METHOD AND APPARATUS FOR AN ACTION SYSTEM FOR A FIREARM

This application claims the benefit of U.S. Provisional Patent App. No. 60/526,540, entitled "Action System For A Firearm," filed Dec. 3, 2003; the contents of which are expressly incorporated herein by reference.

BACKGROUND OF THE INENTION

1. Technical Field

The invention relates generally to the field of firearms, and more specifically to the operating system of a firearm.

2. Background of the Invention

The roller-lock delayed blowback action system has been employed in rifles and sub-machine guns since the 1950's and is well known to those familiar with firearm design, but it has not previously been employed in a semi-automatic shotgun. This is likely because the large diameter of the cartridge would require a disproportionately bulky mechanism and would interfere with the space necessary for feeding and ejecting the cartridges when situated near the front of the bolt—as in all previous known designs. However, it is desirable to provide a roller-lock delayed blowback action system for a shotgun because it would offer an alternative to: gas-operated systems that are subject to fouling; recoil-operated systems that are notoriously unreliable; and straight blowback systems that require an undesirable heavy bolt.

SUMMARY OF THE INVENTION

The present invention is a roller-lock delayed blowback mechanism providing a compact, low-maintenance, reliable, and lightweight action system for a firearm, preferably a semi-automatic shotgun. A primary roller-lock mechanism is located to the rear of the feeding and ejecting ports of the firearm and preferably contained within the approximate diameter of a cartridge.

An alternative embodiment of the present invention further incorporates a secondary, or compounding, roller-lock mechanism within the action system to further delay the opening of the firearm chamber. This is advantageous because locating the locking rollers to the rear of the ejection port obviates the use of a relatively long and proportionately heavy bolt in which the rollers are caged. Thus, a relatively lighter bolt carrier—to be accelerated past inwardly pinching rollers—provides less inertial resistance to the accelerating force than prior conventional designs wherein the bolt carrier is proportionately larger, heavier, and more resistant to acceleration. That is, the reduced delaying effect of the primary roller-lock mechanism brought about by the necessarily diminished physical space requirements, has been increased by compounding the primary roller-lock mechanism rather than by adding mass. In the preferred embodiment, the inertia of a relatively lesser mass (the firing pin and striking hammer) sufficiently delays the opening of the firing chamber until the explosive pressure within is reduced to a safe level by retarding the movement of the bolt carrier relative to the bolt, which in turn retards the movement of the bolt relative to the barrel and receiver of the shotgun. The compounding or additional stage of roller-lock delay is increased similar in effect to compounding a 1:10 gear ratio to produce a 1:100 ratio.

These and other aspects and attributes of the present invention will be discussed with reference to the following drawings and accompanying specification and claims.

DETAILED DESCRIPTION OF THE EMBODIMENT

Figure 1:
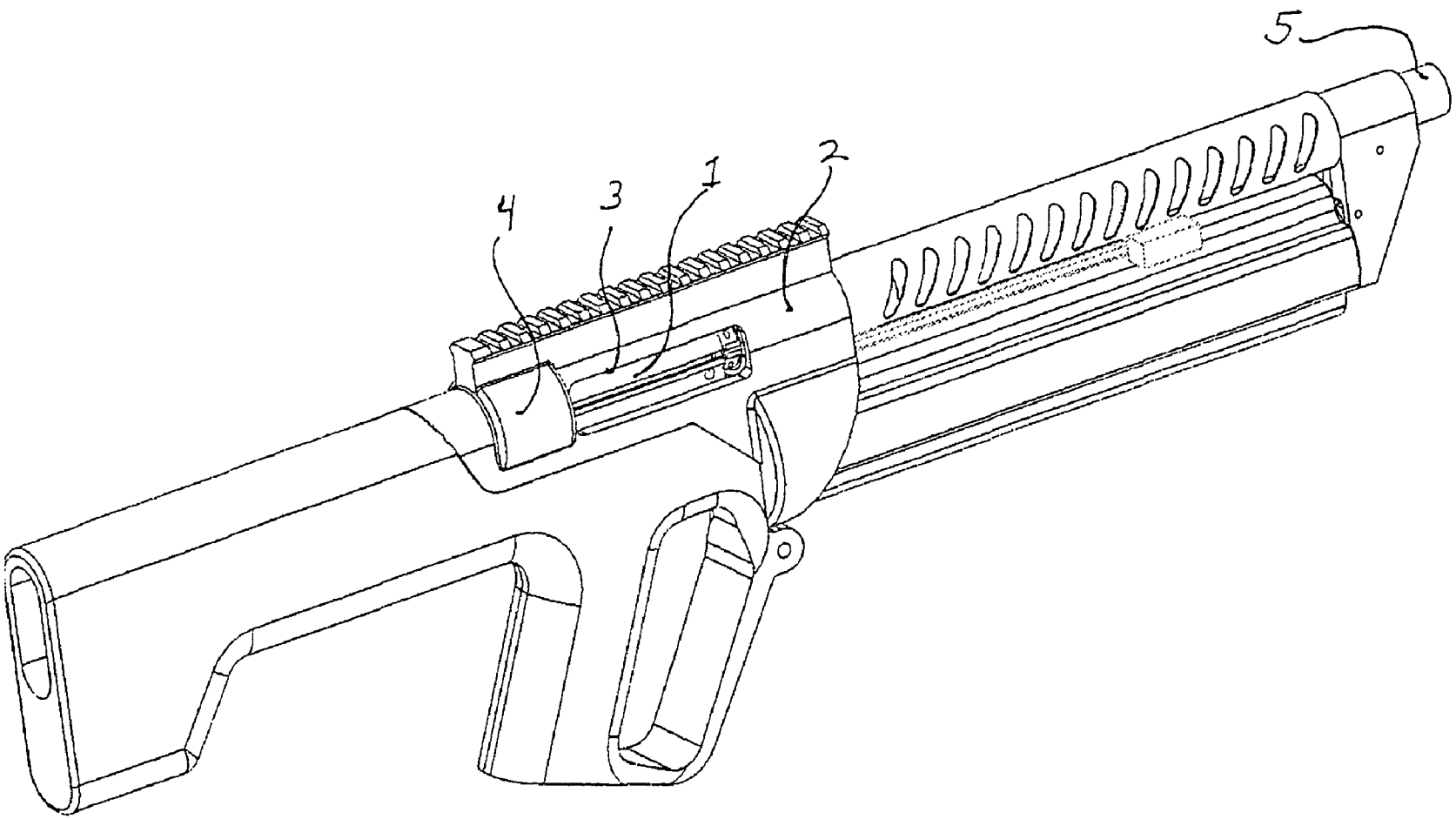
FIG. 1 is a perspective view of a semi-automatic shotgun.

FIG. 1 depicts a semi-automatic shotgun having a roller-lock mechanism deployed within a reinforcing boss 4 on a receiver 2. A bolt 1 rides within the receiver 2 to close a firing chamber 20 in a barrel 5. The bolt 1 extends rearward past an ejection port 3 when out of battery position. It should be noted that in this and other figures, certain details of the firearm not related to the patentable aspects of the present invention—such as the trigger mechanism and magazine-are not enumerated.

Figure 2:
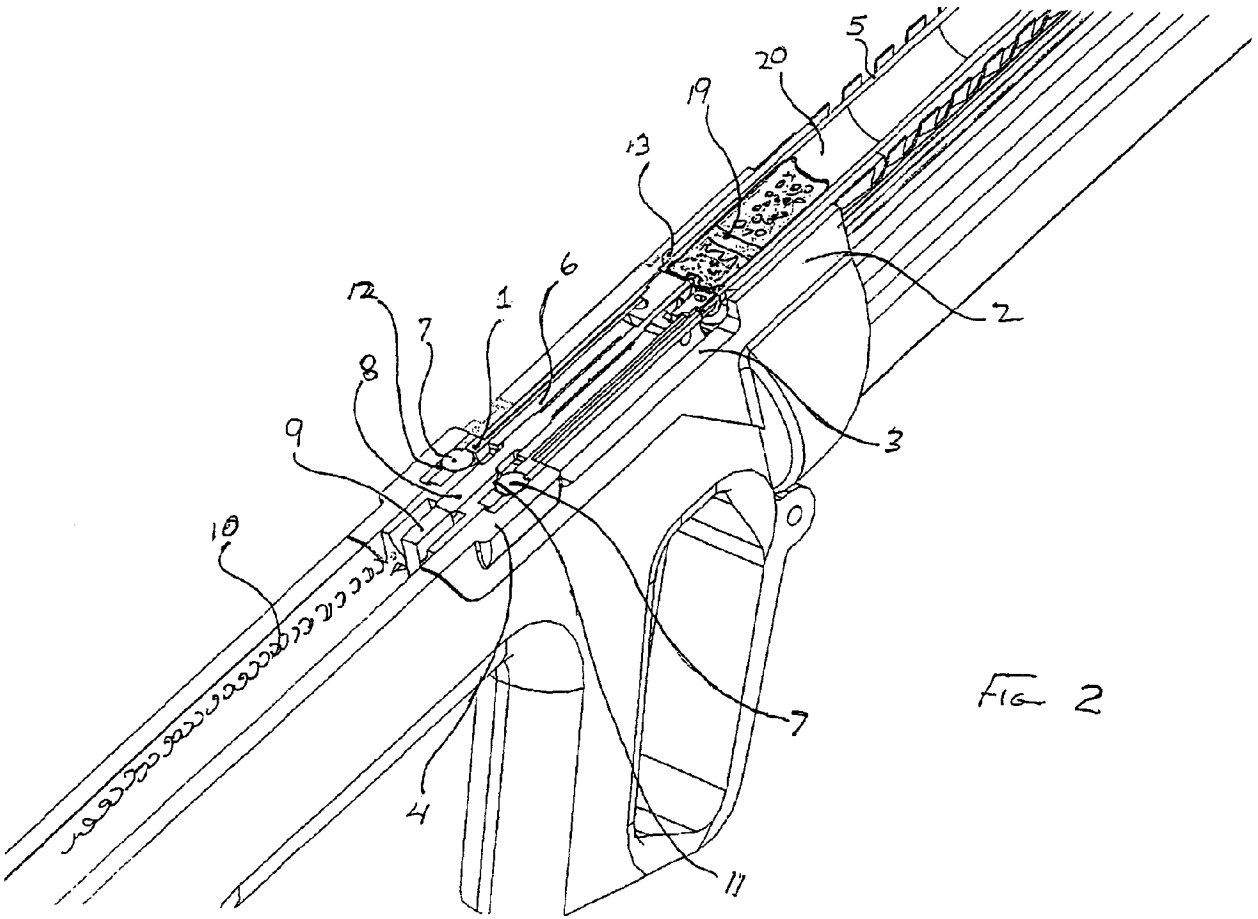
FIG. 2 is a partial horizontal cross-sectional view of the action system of the present invention.
Figure 6:
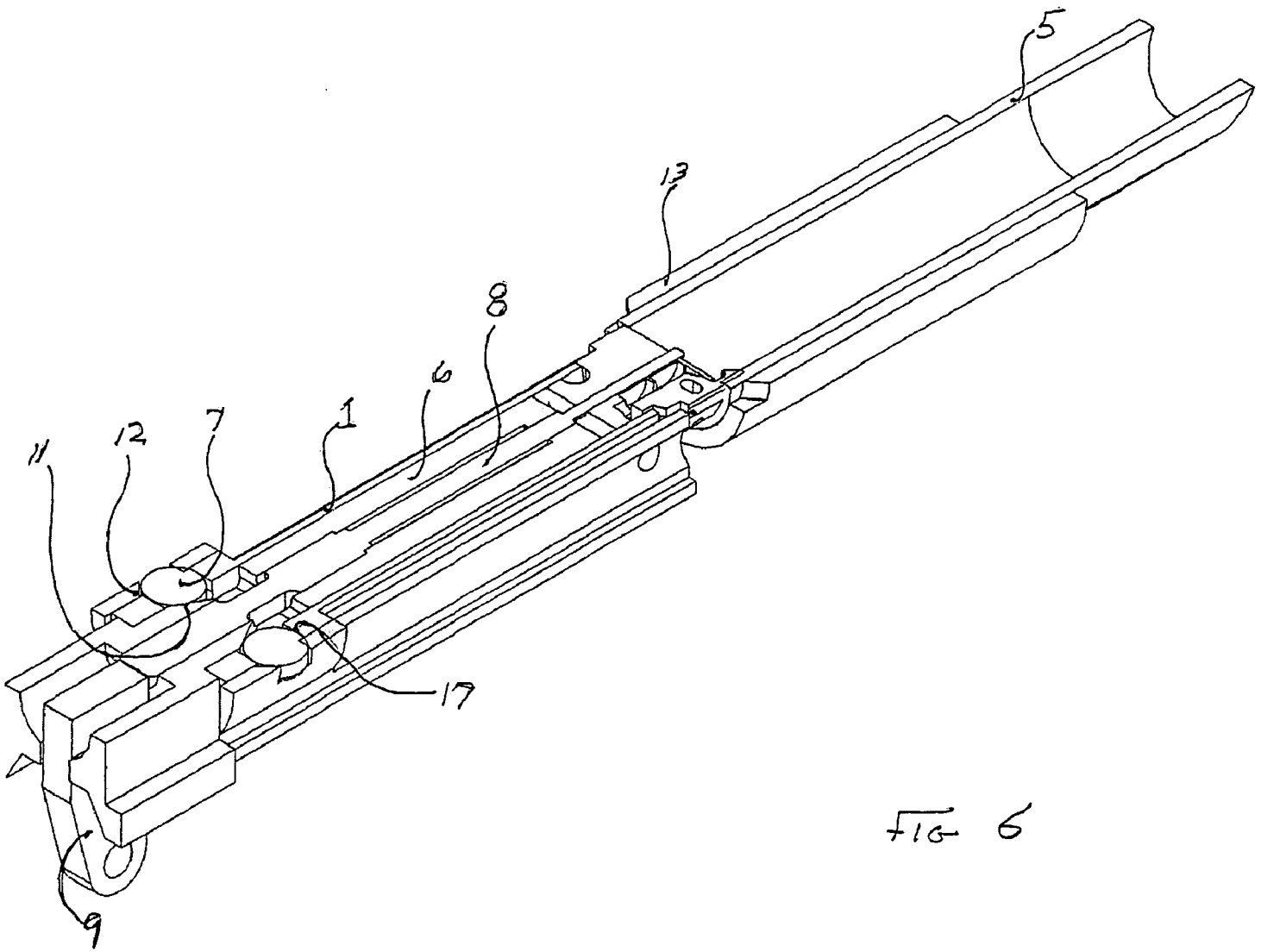
FIG. 6 is a partial perspective horizontal cross-sectional view of the action system of the present invention in battery position.

FIGS. 2 and 6 depict a partial horizontal cross-sectional view about the centerline of the firearm barrel 5 showing the primary roller-lock mechanism of one embodiment of the present invention. The primary roller-lock mechanism is positioned rearward of the ejection port 3 and preferably comprises the bolt 1, a bolt carrier 6, primary bearing(s) 7 (e.g., roller(s)), and a barrel extension 13. When the cartridge 19 is fired by a hammer 9 impinging on a firing pin 8, the explosive gas pressure in the firing chamber 20 forces the bolt 1—which cages the rollers 7—rearward; thus pinching the rollers between detents 12, e.g., angled ramps, in the fixed barrel extension 13 and detents 11, e.g., angled ramps, in the moveable bolt carrier 6. This results in the bolt carrier 6 being rapidly accelerated rearward past the inwardly pinching rollers 7 until the rollers 7 clear the fixed ramps 12 in the barrel extension 13 wherein the bolt 1 is free to travel rearward to eject the spent cartridge 19 through the ejection port 3 and compress the return spring 10.

At the terminus of its rearward travel within the receiver 2, the bolt 1 is impelled forward by the return spring 10 to pick up a new cartridge 19 and load it into the firing chamber 20. When the bolt 1 reaches its forward terminus (in battery), the return spring 10 and inertia continue to drive the bolt carrier 6 forward until its inclined ramps 11 have forced the rollers 7 outward against the inclined ramps 12 of the barrel extension 13, thus wedging the bolt 1 firmly in battery against the barrel 5. This primary roller-lock delay mechanism serves to delay the opening of the firing chamber 20 until the gas pressure is reduced to a predetermined, e.g., safe, level.

Because the delay effect of the primary roller-lock mechanism is chiefly dependant on the inertial resistance of the mass of the bolt carrier (6) and it is undesirable to increase that mass to augment the delay, an alternative embodiment of the present invention incorporates a secondary roller-lock mechanism within the bolt itself.

Figure 3:
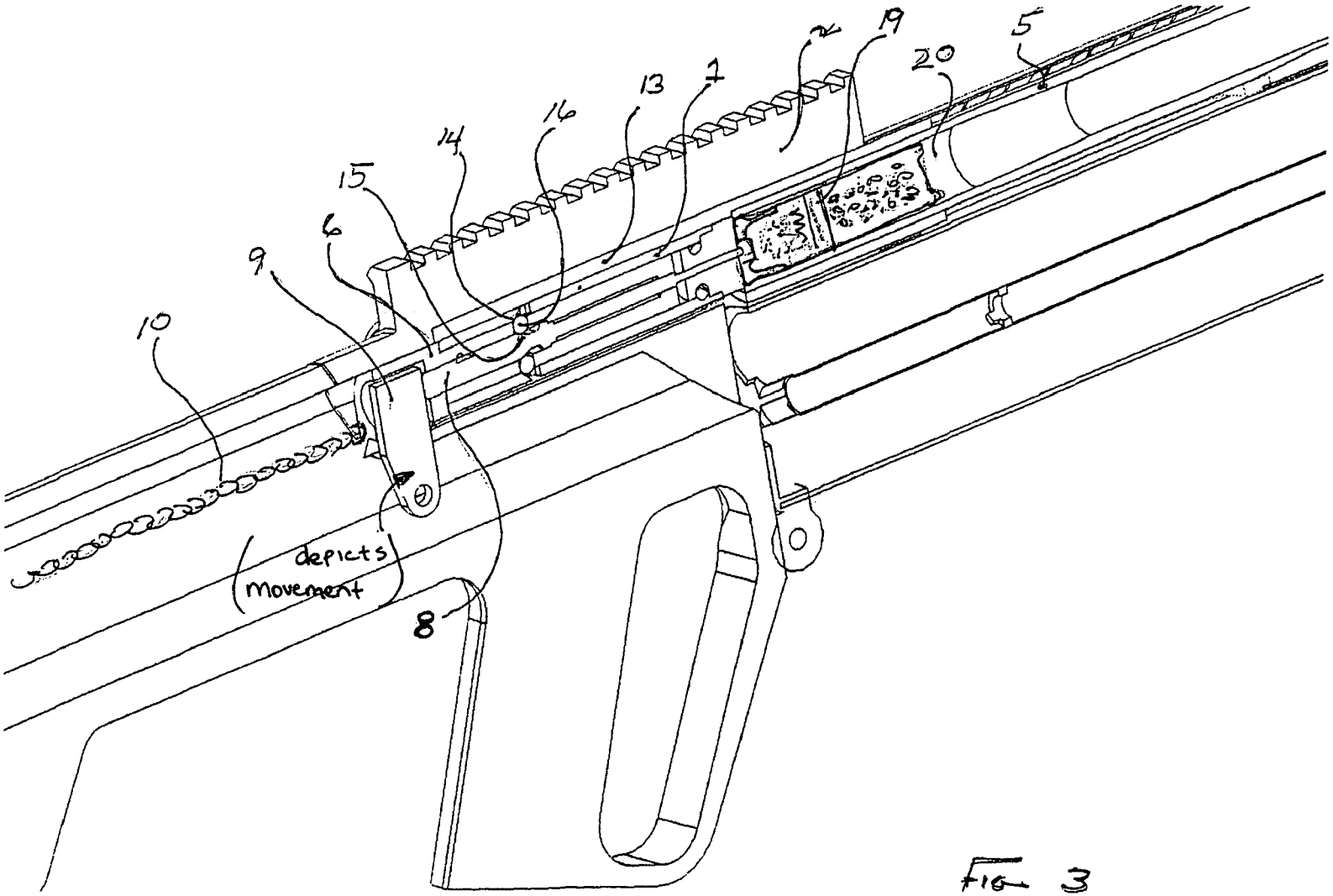
FIG. 3 is a partial vertical cross-sectional view of the action system of the present invention.
Figure 7:
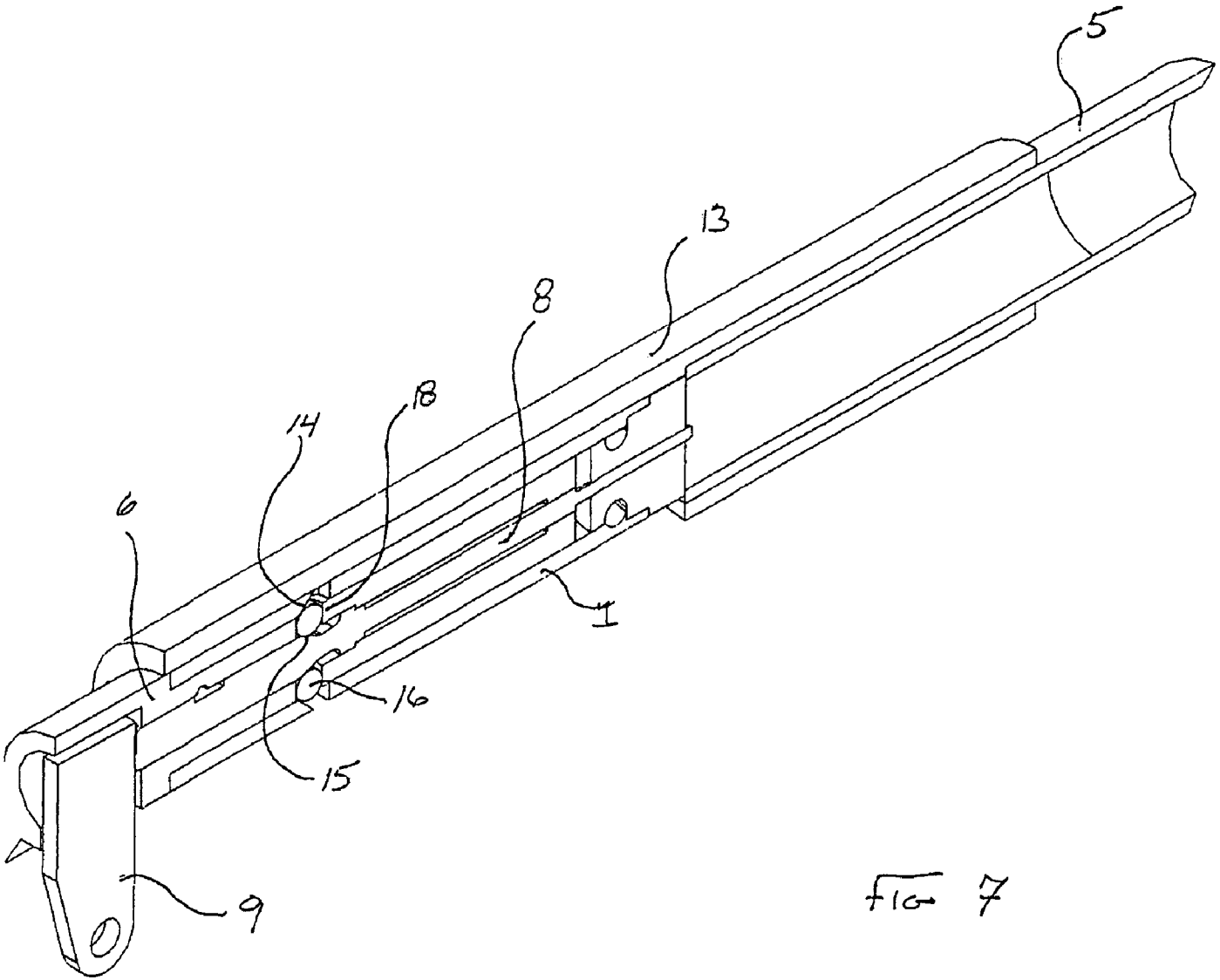
FIG. 7 is a partial perspective vertical cross-sectional view of the action system of the present invention in battery position; and, FIG. 8 is a perspective view of one embodiment of the present invention.

FIGS. 3 and 7 depict a partial vertical cross-sectional view of the secondary, or compounding, roller-lock mechanism comprising a secondary bearing 16, e.g., roller(s), caged within the bolt carrier 6 between detents 14, e.g., inclined ramps, in the bolt 1 and detents 15, e.g., inclined ramps, in the firing pin 8. When a striking hammer 9 is released by the trigger mechanism (not shown), it drives the firing pin 8 forward to ignite the cartridge 19. At the forward terminus of its 8 travel, angled ramps 15 in the firing pin 8 force the secondary rollers 16 caged in the bolt carrier 6 outward against the angled ramps 14 in the bolt 1—effectively wedging the bolt carrier 6 into the bolt 1. When the cartridge 19 is fired, the resulting gas pressure in the firing chamber 20 applies rearward force to the bolt 1. The bolt's movement is delayed by the primary roller-lock mechanism of FIG. 2 described above, and the bolt carrier 6 therein described is delayed from moving relative to the bolt 1 until the secondary rollers 16 caged within the bolt carrier 6 are pinched inward by the inclined ramps 14 in the bolt 1 against the inclined ramps 15 in the firing pin 8—thus accelerating the firing pin 8 rearward against the striking hammer 9. The result of this compounding mechanism is the relatively small inertial mass of the firing pin 8 and striking hammer 9 can effectively and securely delay the opening of the bolt 1 until the gas pressure in the firing chamber 20 has dropped to a safe level.

Figure 4:
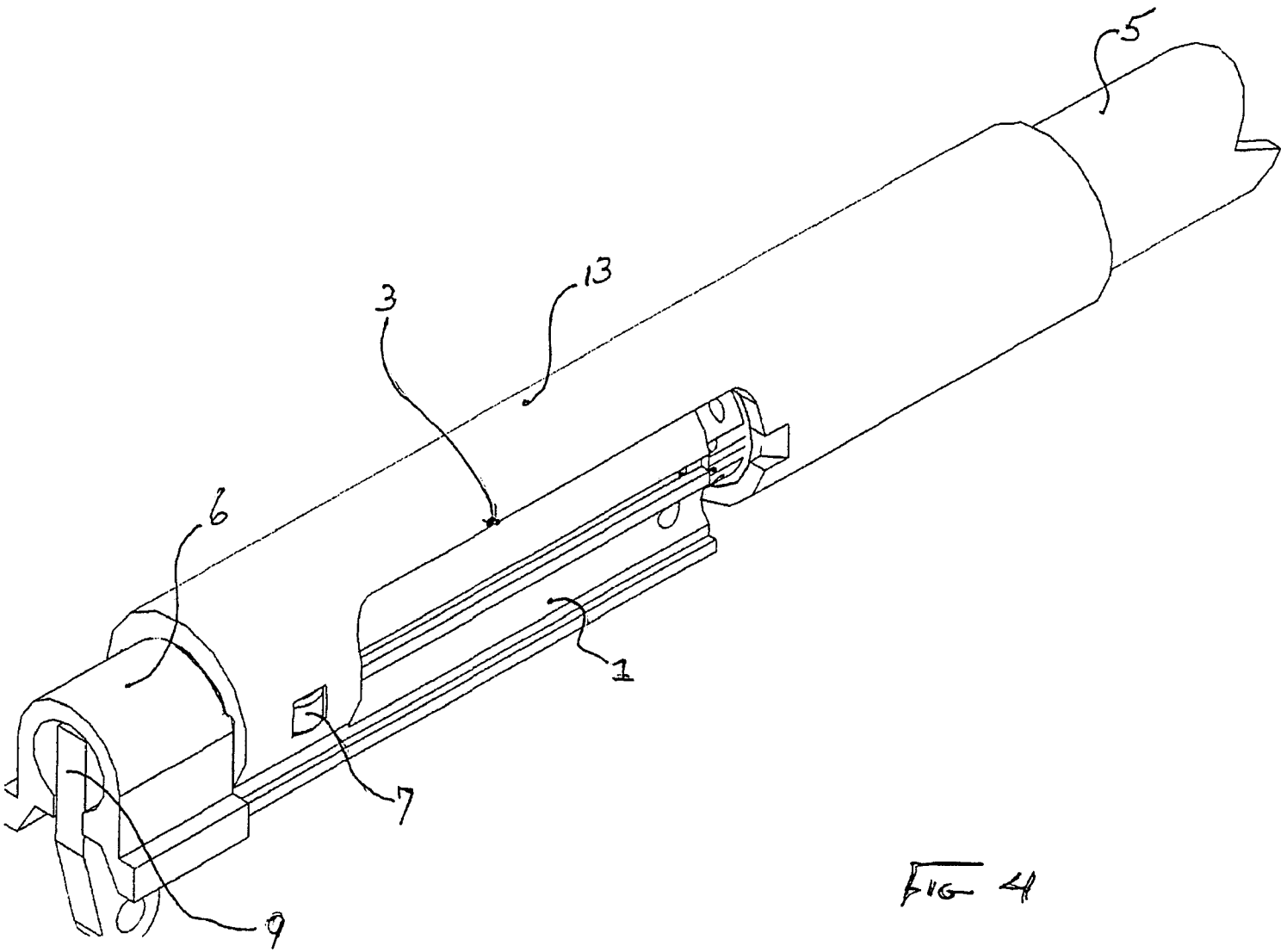
FIG. 4 is a partial perspective view of the action system of the present invention in battery position.

FIG. 4 depicts a partial perspective view of the action system of the present invention in battery position, specifically showing the primary rollers 7 wedged outward by the ramps 11 in the bolt carrier 6 into receiving pocket(s) 22 in the barrel extension 13, and the position of the primary roller-lock mechanism relative to the ejection port 3.

Figure 5:
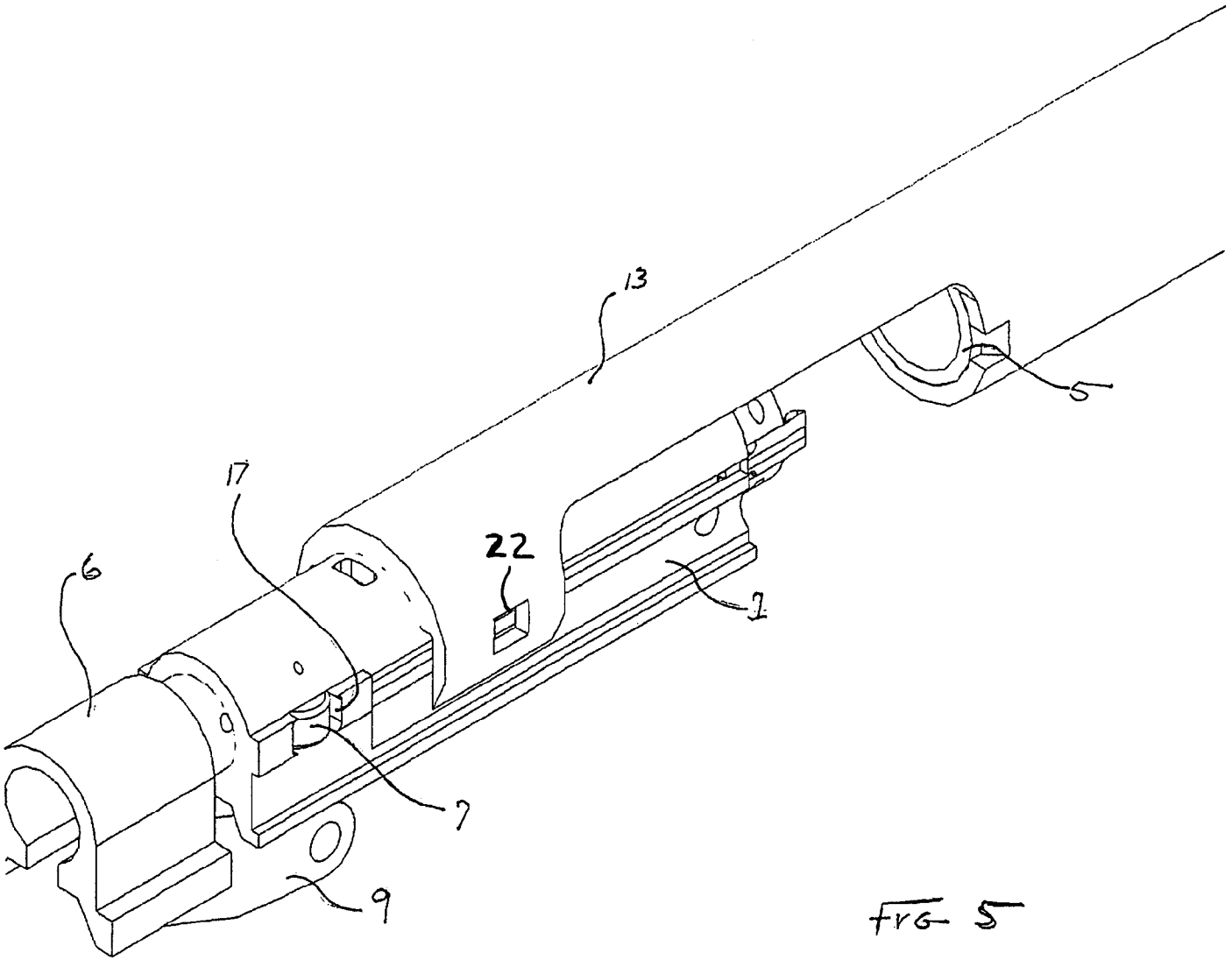
FIG. 5 is a partial perspective view of the action system of the present invention in open position.

FIG. 5 depicts a partial perspective view of the action system of the present invention out of battery position, specifically showing the rollers 7 in the cage 17 in the bolt 1, pinched inward against the ramps in the bolt carrier 6, which is extended rearward relative to the bolt 1.

Figure 8:
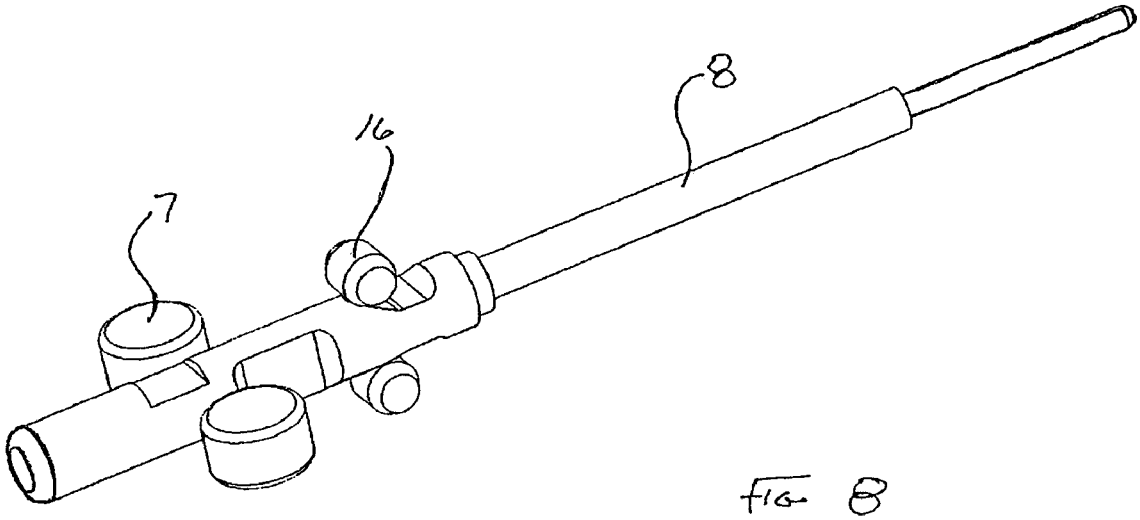

FIG. 8 depicts the relative positions of the primary 7 and secondary 16 rollers to the firing pin 8, which is coaxial with the barrel 5, bolt 1, and bolt carrier 6. It is noted here that the primary and secondary rollers need not necessarily be located in perpendicular planes, or symmetrically opposed about the common centerline, or in a particular forward/rearward orientation, but are so oriented in the preferred embodiment for simplicity and ease of manufacture.

It is to be understood that the present invention preferably utilizes a pair of rollers for the primary roller-lock mechanism, but that a single bearing, e.g., roller, can be utilized to effectively delay the opening of the firing chamber until the explosive pressure within is reduced to a safe level. Similarly, a single bearing or roller can be utilized for the secondary roller-lock mechanism.

It is further to be noted that although the present invention is preferably devised to enable a roller-lock delayed blowback action system for a semi-automatic shotgun, the present invention can easily be employed by one of ordinary skill in the art to firearms other than semi-automatic shotguns.

It is also to be understood that the present invention may be embodied in other specific forms without departing from the spirit or central characteristics thereof. The present embodiments, therefore, are to be considered in all respects as illustrative and not restrictive, and the present invention is not to be limited to the details provided herein. While specific embodiments have been illustrated and described, numerous modification come to mind without significantly departing form the characteristics of the present invention and the scope of protection is only limited by the scope of the accompanying claims.

What is claimed is:

1. A roller delayed blowback action system for a shotgun having an ejection port for ejecting an empty cartridge of an expelled projectile, the roller delayed blowback action system comprising:

a barrel including a longitudinal axis;

a bolt slidable along the longitudinal axis;

a pair of primary rollers located rearward of the ejection port and substantially contained within the bolt, the pair of primary rollers being spaced about the longitudinal axis and on opposing sides thereof, wherein the pair of rollers are capable of movement toward and away from the longitudinal axis;

a bolt carrier slidable along the longitudinal axis and slidably attached to the bolt, the bolt carrier including a pair of bolt carrier ramps; and, a barrel extension including a pair of barrel extension ramps, wherein the pair of bolt carrier ramps and the pair of barrel extension ramps cooperate to facilitate movement of the pair of primary rollers, thus effectively delaying movement of the bolt and bolt carrier in response to firing of the shotgun.

2. The action system of claim 1, wherein the shotgun firearm is semi-automatic.

3. The action system of claim 1, further comprising:

a pair of secondary rollers substantially contained within the bolt carrier, the pair of secondary rollers being spaced about the longitudinal axis and on opposing sides thereof, wherein the pair of secondary rollers are capable of movement toward and away from the longitudinal axis;

a pair of bolt ramps extending from the bolt; and, a firing pin having a pair of detents, wherein the pair of secondary rollers, the pair of bolt ramps, and the pair of detents being configured to facilitate movement of the pair of secondary rollers, thus further effectively delaying movement of the bolt and bolt carrier in response to firing of the shotgun.

4. The action system of claim 3 wherein the shotgun is semi-automatic.

5. A method for delaying an action system of a shotgun having an ejection port for ejecting an empty cartridge of an expelled projectile, the method comprising the steps of:

providing a roller delayed drawback mechanism including:

a pair of primary rollers substantially contained within a bolt;

a bolt carrier ramp attached to a bolt carrier; and, a barrel extension ramp attached to a barrel extension; and, positioning the pair of primary rollers rearward of the ejection port;

wherein movement of the bolt and bolt carrier relative to the ejection port is sufficiently delayed until explosive pressure resulting from firing the shotgun is reduced to a predetermined level.

6. The method of claim 5 wherein the roller delayed blowback mechanism further includes:

a pair of secondary rollers substantially contained within the bolt carrier;

a firing pin including a pair of detents; and, a pair of bolt ramps attached to the bolt; and, positioning the pair of secondary rollers rearward of the ejection port, wherein movement of the bolt relative to the bolt carrier is sufficiently delayed until explosive pressure resulting from firing the shotgun is reduced to a predetermined level.

7. A roller delayed blowback action system for a semi-automatic shotgun capable of expelling a projectile from a cartridge, the semi-automatic shotgun having an ejection port for ejecting an empty cartridge of the expelled projectile, the action system comprising:

a bolt having a diameter substantially the same as the diameter of the cartridge;

a bolt carrier slidably attached to the bolt;

a bolt carrier ramp attached to the bolt carrier;

a barrel extension including a barrel extension ramp; and, a primary roller contained substantially within the bolt and located rearward of the ejection port, wherein the bolt carrier ramp and barrel extension ramp cooperate to effectively delay movement of the bolt and bolt carrier in response to firing of the shotgun.

8. The action system of claim 7, further comprising:

a secondary roller contained substantially within the bolt carrier;

a bolt ramp attached to the bolt;

a firing pin having a detent, wherein the bolt ramp and the detent are configured to cooperate and further effectively delay movement of the bolt and bolt carrier in response to firing of the shotgun.

9. The action system of claim 8, further comprising:

another secondary roller, the secondary roller and the another secondary roller being symmetrically opposed about the longitudinal axis.

10. The action system of claim 7, further comprising:

another primary roller, the primary roller and the another primary roller being symmetrically opposed about the longitudinal axis.

11. A roller delayed blowback action system for a shotgun capable of expelling a projectile from a cartridge, the shotgun having an ejection port for ejecting an empty cartridge of the expelled projectile, the action system comprising:

a bolt slidable along a longitudinal axis;

a bolt carrier slidable along the longitudinal axis and including a bolt carrier ramp, the bolt carrier being slidably attached to the bolt;

a barrel extension including a barrel extension ramp; and, a primary roller located rearward of the ejection port, the primary roller being substantially contained within the bolt and positioned proximate the bolt carrier ramp and the barrel extension ramp, wherein the bolt carrier ramp and the barrel extension ramp cooperate to facilitate movement of the primary roller within a plane including the longitudinal axis in response to firing of the shotgun.

12. The action system of claim 11 further comprising:

the bolt carrier including another bolt carrier ramp;

the barrel extension including another barrel extension ramp; and, another primary roller located rearward of the ejection port and substantially contained within the bolt and positioned proximate the another bolt carrier ramp and the another barrel extension ramp, the another primary roller further positioned across the longitudinal axis from the primary roller and within the plane, wherein movement of the primary roller and the another primary roller being confined within the plane in response to firing of the shotgun.

13. The action system of claim 12, wherein the primary roller and another primary roller are spaced apart a distance perpendicular to the longitudinal axis and capable of movement there between.

14. The action system of claim 12, wherein the primary roller and the another primary roller are symmetrically opposed about the longitudinal axis.

15. The action system of claim 11 further comprising:

a bolt ramp extending from the bolt;

a firing pin having a detent; and, a secondary roller located rearward of the ejection port, the secondary roller being substantially contained within the bolt carrier and positioned proximate the bolt ramp and the detent of the firing pin, wherein the bolt ramp and the detent of the firing pin cooperate to facilitate movement of the secondary roller within a second plane including the longitudinal axis, in response to firing of the shotgun.

16. The action system of claim 15 further comprising:

the bolt including another bolt ramp;

the firing pin including another detent; and, another secondary roller located rearward of the ejection port and substantially contained within the bolt and positioned proximate the another bolt ramp and the another detent, the another secondary roller further positioned across the longitudinal axis from the secondary roller and within the second plane, wherein movement of the secondary roller and the another secondary roller being confined within the second plane, in response to the firing of the shotgun.

* * * * *

UNITED STATES PATENT AND TRADEMARK OFFICE

CERTIFICATE OF CORRECTION

PATENT NO. : 7,299,737 B2
APPLICATION NO. : 11/003073
DATED : November 27, 2007
INVENTOR(S) : Jeffrey A. Hajjar and Warren D. Stockton It is certified that error appears in the above-identified patent and that said Letters Patent is hereby corrected as shown below:

Col. 4, line 28 the word "firearm" should be deleted

Col. 4, line 49 the word "drawback" should be -- blowback --.

Signed and Sealed this

Sixth Day of May, 2008

JON W. DUDAS
*Director of the United States Patent and Trademark Office*